United States Patent [19]

West

[11] 4,020,509

[45] May 3, 1977

[54] COMBINATION WOOD AND ALUMINUM SWIMMING POOL WALL STRUCTURE

[75] Inventor: Robert E. West, Yardley, Pa.

[73] Assignee: Cascade Industries, Incorporated, Edison, N.J.

[22] Filed: Aug. 14, 1975

[21] Appl. No.: 604,745

[52] U.S. Cl. ..... 4/172.19

[51] Int. Cl.[2] ..... E04H 3/16; E04H 3/18; F16L 22/02

[58] Field of Search ..... 4/172.19, 172, 172.11; 52/169, 269, 73, 615

[56] References Cited

UNITED STATES PATENTS

| | | | |
|---|---|---|---|
| 3,233,251 | 2/1966 | Barrera | 4/172.19 |
| 3,256,532 | 6/1966 | Lindsey et al. | 4/172.19 |
| 3,371,455 | 3/1968 | Fox | 52/169 |
| 3,409,916 | 11/1968 | Billig et al. | 4/172.19 |
| 3,444,659 | 5/1969 | Shanni | 4/172.19 X |
| 3,458,875 | 8/1969 | Michalke et al. | 4/172.19 |
| 3,551,920 | 1/1971 | Greene | 4/172.19 |
| 3,793,651 | 2/1974 | Pitti et al. | 4/172.19 |
| 3,877,085 | 4/1975 | Bukaitz | 4/172.19 |

*Primary Examiner*—Henry K. Artis
*Attorney, Agent, or Firm*—Sperry and Zoda

[57] ABSTRACT

A swimming pool is provided with side walls made up of a plurality of panels each embodying upper and lower receptor beams in the form of oppositely facing channels supporting the upper and lower horizontal edges of plywood sheets, with bracing members located between the vertical edges of the plywood sheets and secured at their upper and lower ends to the receptor beams so as to support each sheet about the entire peripheral edges thereof. The panels are secured together in selected arrangements by fasteners and splice plates at the adjacent ends thereof to establish a unitary structure of exceptional strength which may be made up of a limited number of inexpensive elements adapted to be assembled and erected with a minimum of labor.

5 Claims, 5 Drawing Figures

COMBINATION WOOD AND ALUMINUM SWIMMING POOL WALL STRUCTURE

FIELD OF INVENTION

In constructing swimming pools hereto it has been common practice to form the side walls of prefabricated galvanized steel, aluminum or other metal members and to line the pool with a plastic liner which extends over the bottom side walls of the assembly to confine the water within the pool as examplified by U.S. Pat. Nos. 3,192,538; 3,440,780; 3,820,174 and others. However, the cost involved in fabricating and assembling such sheets is often substantial and it is generally necessary to use highly skilled workmen in order to complete the assembly properly.

Attempts have been made to construct the side walls of such pools of sheets of material such as cement asbestos composition, plywood and the like supported by wooden timbers or framing but such assemblies are often weakened or rotted in a relatively short time. Moreover when using preformed sheets of material in constructing the walls of a swimming pool it is not generally possible to preassemble the panels prior to installing them in place in the pit or cavity in which the pool is installed.

THE PRESENT INVENTION

In accordance with the present invention the walls of swimming pools are capable of being formed and assembled in any convenient location or adjacent the area in which the pool is to be located using conventional carpenters tools and unskilled labor employing inexpensive materials. Moreover the pool walls can be assembled in sections or panels of desired length or in modules of predetermined length so as to construct pools of any desired dimensions required. Furthermore the walls of the pool are preferably formed of conventional ⅝ inch waterproof or marine plywood in sheets of standard dimensions which are relatively inexpensive and readily available on the market.

The sheets of wallboard are held securely in place by extruded aluminum mounting members and metal supports and angle members which are capable of being preassembled by means of bolts, rivets and the like and thereafter set in place and attached to each other in a manner to receiver a vinyl plastic liner or the like.

THE DRAWINGS

PREFERRED EMBODIMENT

Figure 1:
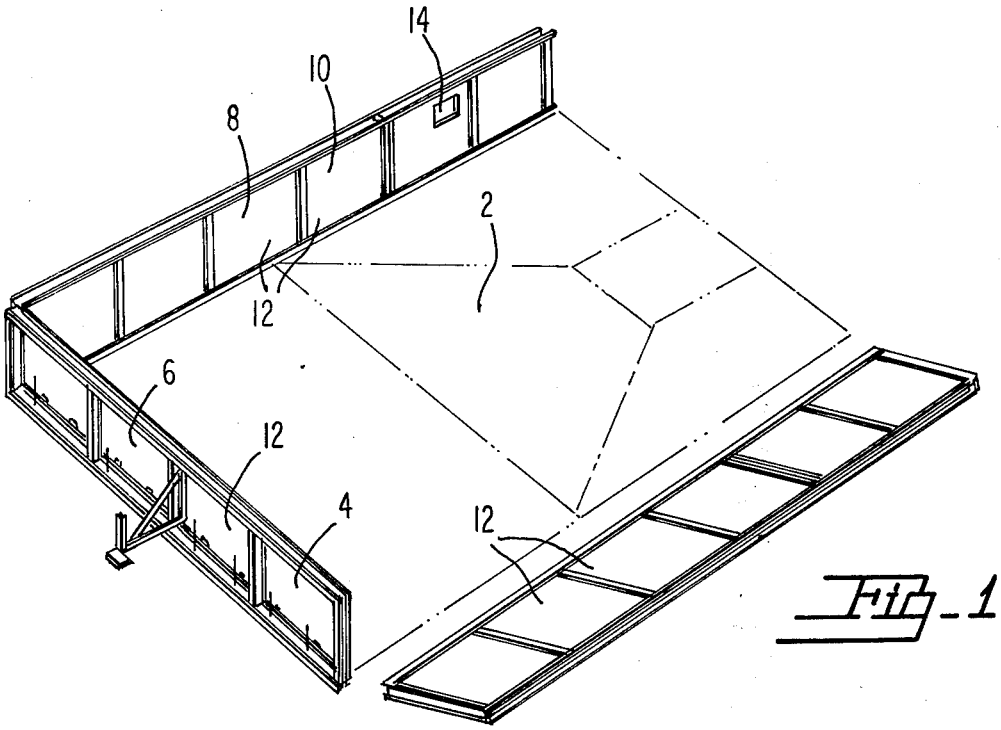
FIG. 1 is a perspective illustrating a portion of a swimming pool embodying the present invention.

In that form of the invention chosen for purposes of illustration in FIG. 1, the floor 2 of the pool is surrounded by walls made up of a plurality of panels 4, 6, 8, 10 etc. The panels each embody a plurality of standard sheets of plywood 12 and each of the panels may be of any desired length. However, one or more of the panels may be formed with an opening 14 to accommodate conventional water inlets, skimmers, filters and the like for use in filling and operating the pool.

Figure 3:
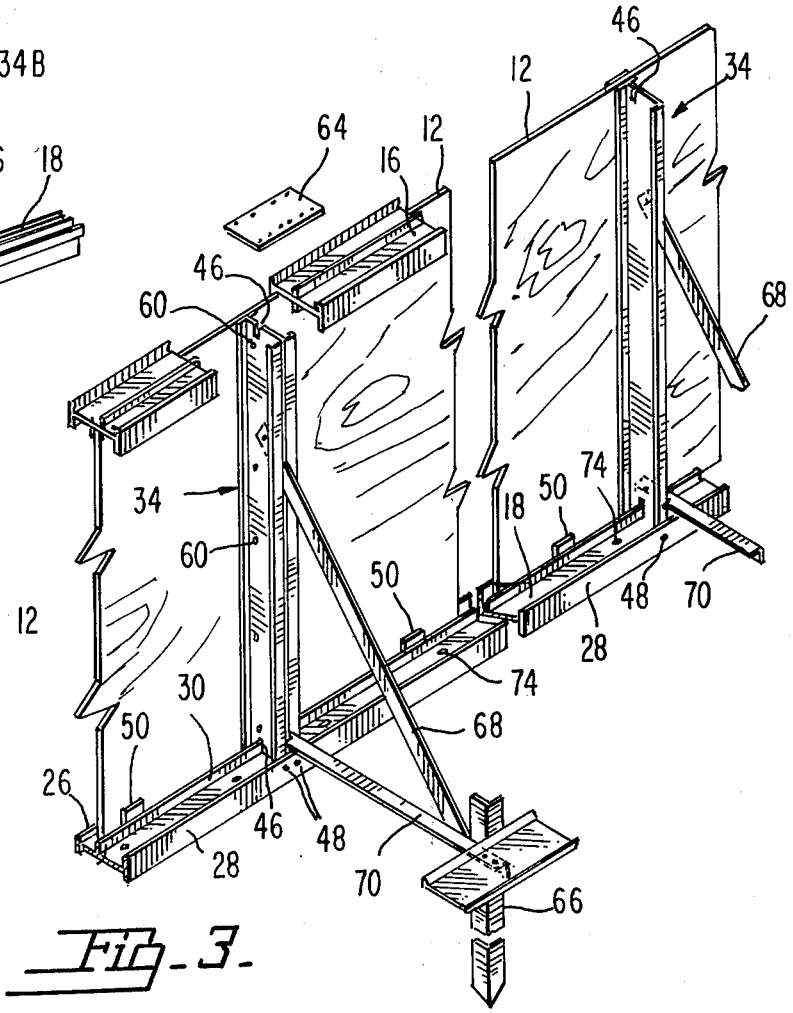
FIG. 3 is a perspective illustrating the details of the joint between two panels of the pool of FIG. 1.
Figure 4:
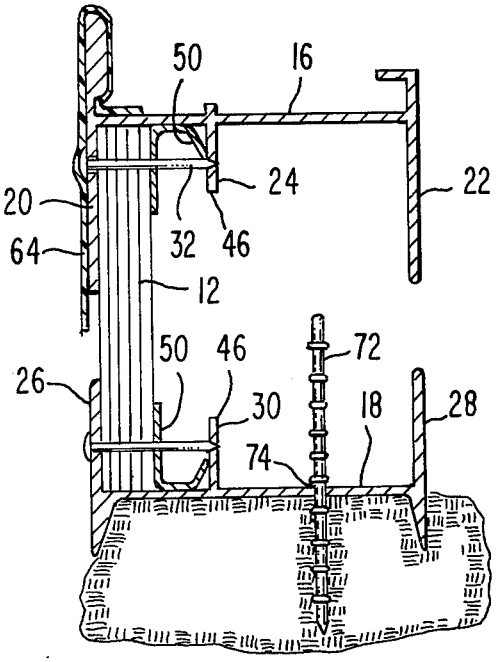
FIG. 4 is a vertical sectional view through the assembly of FIG. 3.

As shown in FIGS. 3 and 4 each panel embodies upper and lower horizontal beams or receptors 16 and 18 which are preferably formed of extruded aluminum and uniform in cross sections throughout the length thereof. Such receptors may be of any desired length or may be cut to special lengths as required to produce pools of any selected size or shape needed.

The receptors may be constructed and formed generally as shown in U.S. Pat. No. 3,440,780. For this purpose the upper horizontal receptor 16 is arranged to present a downwardly facing channel having inner and outer side flanges 20 and 22 respectively together with a longitudinally extending rib 24 spaced from the inner side flange 20. Conversely the lower horizontally extending receptor 18 is inverted to present an upwardly facing channel having an inner side flange 26 and an outer side flange 28 together with a longitudinally extending rib 30 spaced from inner side flange 26 of the receptor.

The sheets of plywood 12 are positioned with their upper edges located in the space between the inner flange 20 and the longitudinal rib 24 of the downwardly facing channel of the upper receptor 16 while the lower horizontal edges of the sheets of plywood are located in the space between the longitudinal rib 30 and the inner flange 26 of the upwardly facing channel of the lower receptor 18. Stronghold screwnails 32 are driven through the inner flanges 20 and 26 through the plywood sheets into the adjacent longitudinal ribs 24 and 30 to positively secure the upper and lower horizontal edges of the sheets in place.

Figure 5:
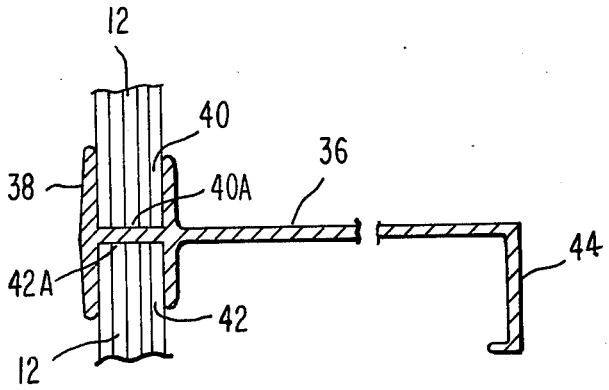
FIG. 5 is a horzontal sectional view through the joint between panels in the assembly in FIG. 3.

The vertical edges of the sheets of plywood 12 are held rigidly in place by vertically extending bracing members 34 which may also be formed of aluminum extrusions or the like and as shown in FIGS. 3 and 5 preferably provided with a body in the form of a web 36 having a generally T-shaped head 38 having oppositely facing slots 40 and 42 for receiving the vertical edges 40A and 42A of adjacent plywood sheets 12. The outer vertical edge 44 of the web 36 of the bracing members 34 are preferably turned at right angles to the web 36 so that in combination with the T-shaped head 38 the bracing member will have the strength and rigidity of a structural beam. The upper and lower ends of the web 36 of each bracing member is formed with a notch 46 adapted to receive longitudinally extending ribs 24 and 30 of the upper and lower receptors 16 and 18 whereby the receptors and bracing members are accurately positioned. Thereafter, bolts or rivets 48 are passed through the vertical edge of the bracing member and the outer flanges 22 and 28 of the upper and lower receptors whereby each sheet of plywood is provided with a rigid structural frame surrounding the sheet and serving to afford the utmost strength thereto. Further in order to preclude possible flexing of the upper and lower horizontal edges of the sheets between the bracing members 34, strong steel spacing elements 50 of wedge formation are driven into the space between the longitudinally extending ribs 24 and 30 and the outer surfaces of the sheets 12 at suitable intervals of say one foot apart.

Figure 2:
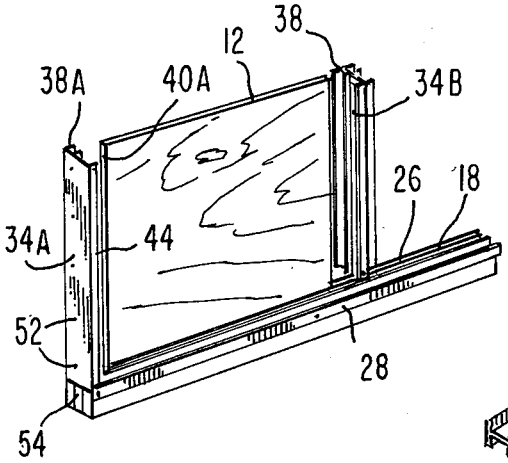
FIG. 2 is a perspective illustrating the manner in which panels embodied in the pool of FIG. 1 are assembled.

At each end of each panel an end-type bracing member may be provided as shown in 38A in FIG. 2 wherein a sheet receiving slot 40 is formed on one side only of the web 36 of the bracing member and the inner edge 44 of the web is reversely turned so as to be parallel with the web 36 itself. In this way when adjacent panels of the pool walls are placed in engagement with one another, they may be secured together by bolts 52 to constitute an I-beam assembly of increased strength.

In producing any of the various panels 4, 6, 8 and 10 etc., required to construct any pool, a very simple precedure may be followed as shown in FIG. 2. As there shown, three 2 × 4 strips of wood of suitable length are nailed together as a base 54 and the lower receptor 18 is placed in an upwardly facing position thereon. An end type bracing member 34A is then positioned upright at right angles to the receptor 18 with the notch 46 in the lower end thereof fitting the longitudinal rib 30 of the receptor and with the head 38A of the end bracing member engaging the upper edge of the inner flange 26 of the receptor. A sheet of plywood 12 is then slipped into the space between flange 26 and the longitudinally extending rib 30 of the receptor and the vertical edge 40A of the sheet 12 is inserted into the slot 40 of the head 38A in the head of the end bracing member 34A. A bolt 48 is then passed through the lower end of the vertical edge 44 of the web 36 of the bracing member and the outer flange 28 of the receptor 18.

A second bracing member 34B is then erected in the same manner on the lower receptor 18 and spaced from the end bracing member 34A a sufficient distance to receive the opposite edge of a standard sheet of plywood 12, say for example four feet. In this way each of the various panels 4, 6, 8 and 10 etc., required in forming the walls of the pool can be made up with as many sheets of plywood as may be necessary for producing a panel of the desired length.

After any one or more of the panel is partially assembled as described above, the upper receptor 16 for the panel may be applied thereto in a position inverted with respect to the lower receptor 18 to receive the upper edges of the various sheets of plywood and the upper ends of the various bracing members 34A, 34B, etc., and to insert the longitudinally extending rib 24 thereof into the corresponding notches in the upper ends of the webs 36 of the bracing members. Drivescrews or fasteners 32 may then be driven through the inner flange 20, the upper portion of the sheet of plywood and into the longitudinal rib 24 of the upper receptor to complete the panel.

The panels containing any suitable number of plywood sheets may be assembled in the manner described above, while lying horizontally on the ground or held in a vertical position as desired or convenient in any location near the pool site or in a fabricating plant for transportation to the pool location. Thus the panels may in fact be prefabricated in standard or modular dimensions or to any desired specifications without the need for any special forms of fixtures.

When the pool walls are to be assembled, the end bracing members 34A of adjacent panels are placed in engagement and after being secured together by the bolts 60, a splice plate 64 is placed over the joint between the panels and bolted or otherwise secured to the abutting end portions of the upper receptors 16 as shown in FIG. 3.

The panels can then be set into place about the sides of the pool excavation and adjusted in place with the upper edges thereof in a level position. Ordinarily the lengths of 2 × 4 wood used as the fabricating base 54 are removed from the panel before the panels are set in place and the downwardly projecting inner and outer flanges of the lower receptors 18 are set into the earth foundation as described more fully in U.S. Pat. No. 3,440,780. Similarly the inner and outer flanges of the upper receptor 16 are preferably formed as described in said patent to receive and hold a plastic liner 64 for the pool and a conventional coping surrounding the edges of the pool.

In order further to assure the desired strength and rigidity of the walls of the pool, the assembly is provided with anchor posts 66 spaced outwardly from the walls of the pool and connected by the inclined rods 68 secured to the web 36 of the bracing members and by spacing rods 70 connected to the lower receptors 14 of the assembly. In addition retaining rods 72 may be passed downward through holes 74 in the lower receptors.

The construction thus provided not only serves to simplify the operations involved in fabricating and installing the pool walls but also renders it possible to use much less expensive materials, such as standard sheets of ⅝ inch marine or treated plywood. Furthermore each plywood sheet and each panel embodying several such sheets is completely surrounded by a rigid metal framework of sufficient strength to withstand the pressures, forces and vibrations applied thereto by the water within the pool and by the weight, shifting or settling of the back fill and earth on the outer side of the walls of the pool.

While the construction illustrated in the drawings and described above is typical of the present invention, it will be understood that the embodiment of the invention disclosed is intended to be illustrative only and is capable of numerous modifications and changes in the form, constructions and arrangement of the various elements of the combination. Furthermore while the construction is particularly adapted for use when using sheets of plywood such sheets may be formed of other suitable material if desired.

I claim:

1. A swimming pool comprising a plurality of panels joined together at their ends to form the side walls of a swimming pool, each of said panels including upper and lower horizontal receptors extending throughout the length of the panels and formed with oppositely facing channels, a plurality of sheets of plywood embodied in each panel and having the upper and lower edges thereof located in the channels of said receptors and abutting the inner side of said channel so as to be held against inward displacement thereof, a longitudinally extending rib in each channel spaced from the side of the channel engaged by the plywood sheets, means between said rib and panel for holding said panels in engagement with said inner side of the channel, fastening means passing through said side of each channel and through said plywood sheets and into said ribs to secure the plywood sheets to the receptors, vertically extending stiffening means secured at their upper and lower ends to said horizontal receptors and formed with oppositely facing grooves therein in which the vertical edges of adjacent plywood sheets are located, said stiffening members having notches in the upper and lower ends thereof in which the longitudinally extending ribs of said receptors are received to position and strengthen the vertical edges of said sheets of plywood.

2. A swimming pool as defined in claim 1 wherein said stiffening members are in the form of webs extending at right angles to said sheets of plywood and are fixedly secured to the opposite sides of the upper and lower horizontal receptors.

3. A swimming pool as defined in claim 1 wherein wedging elements are positioned between the longitudinally extending ribs in said receptors and the adjacent surface of said sheets of plywood between said bracing members.

4. A swimming pool as defined in claim 1 wherein the bracing members at the ends of said adjacent panels are placed in abutting relation and a splice plate is located in the channels of the upper beams of said abutting panels and secured thereto to hold said panels is fixed predetermined position.

5. A swimming pool as defined in claim 1 wherein anchor posts are spaced outwardly from said panels and bracing members extend in inclined positions and secured to said stiffening members and anchoring posts.

* * * * *